US007494376B1

(12) United States Patent
Foltz

(10) Patent No.: US 7,494,376 B1
(45) Date of Patent: Feb. 24, 2009

(54) MULTIPLE DIRECTION WIRE COVER WITH POSITIONING LATCH AND POSITION ASSURANCE LOCK

(75) Inventor: Keith Richard Foltz, Duncannon, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/045,057

(22) Filed: Mar. 10, 2008

(51) Int. Cl.
*H01R 13/40* (2006.01)

(52) U.S. Cl. ..... 439/596

(58) Field of Classification Search ..... 439/901, 439/446, 6, 13, 464, 840, 371, 312–319, 439/321, 320, 470, 322, 323, 471–473, 307, 439/310, 311, 180, 352, 350, 469, 488–489
See application file for complete search history.

(56) References Cited

U.S. PATENT DOCUMENTS 5,315,062 A * 5/1994 Hoshino ..... 439/446
5,688,144 A * 11/1997 Kosuge ..... 439/596
6,962,504 B2 * 11/2005 Fukui et al. ..... 439/466
7,186,133 B1 3/2007 Szczesny

* cited by examiner

*Primary Examiner*—Edwin A. Leon

(57) ABSTRACT

A multi-positional wire cover having a first piece configured to detachably engage a second piece having an opening configured to allow passage of one or more wires. The second piece is moveable about the first piece and removable to a second position once a first position is found. The wire cover has a feature that provides both an audible and tactical indication of an available position. A lock is provided to secure the second piece in place once a desired location is determined.

22 Claims, 8 Drawing Sheets

MULTIPLE DIRECTION WIRE COVER WITH POSITIONING LATCH AND POSITION ASSURANCE LOCK

FIELD OF THE INVENTION

The present invention is directed to a connector with multiple wire routing positions and more specifically, a two-piece wire cover with multiple wire routing positions using a latch and proper routing position assurance.

BACKGROUND OF THE INVENTION

Connectors are required to provide electrical power or electrical or electronic signals between components, such as computers, printers, auxiliary hardware, etc. Often, these connections are required in less than optimum areas and require protection from shorts, damage, and other obstacles that may interfere with the transmission of the power or other signals. It is therefore desirable for the connectors to provide support, protection and direction/orientation to the wires and other materials transmitting the power or data.

Connector systems, including automotive connectors systems, often require that wires be routed in different directions and/or with differing orientation depending on connector location and wire routing within the vehicle. An example of a known system is shown in FIGS. 1 and 2, wherein a connector system 100 utilizes a wire cover 101 to engage connector 103. FIG. 1 shows the connector 103 and wire cover 101 in a disengaged position and FIG. 2 shows the connector 103 and the wire cover 101 in an engaged position. As shown in FIGS. 1 and 2, the wire cover 101 permits routing of the wires in a single direction, wherein alternate wiring directions, when desired, would require a wire cover 101 configured differently. Specifically, accommodating these various routings often require tooling and molding several different wire covers that mate to the same connector but have different wire routing directions. The single direction routing wire covers cause added expense to tool, store and maintain these multiple part options. The known wire cover systems are typically shipped separately or as a kit. In either case, a customer must assemble the wire cover onto the connector after inserting the contact wires, causing an added expense for the customer to assemble them.

In addition, wire cover systems that allow for different wire routing options are either a single molded cover with two or more fixed exits or two piece covers where one piece fits on the other and can be positioned to the desired routing location but does not have a way to be locked into position to assure the correct routing location without the use of tape or wire ties, thus making wire routing changes difficult.

Therefore, there is a need for a two piece wire cover offering multiple directions for routing wire that also has a built in position assurance feature to assure and lock in proper wire routing.

SUMMARY OF THE INVENTION

The present invention is directed to a wire cover having a first piece with a collar, where the collar has a plurality of notched slots along an outside surface. The wire cover also has a second piece that secures around the collar of the first piece. The second piece has a latch and a lock, and the latch has at least one raised bump. The second piece is rotatable about the collar, and the at least one raised bump is configured to fit in each notched slot of the plurality of notched slots. The raised bump produces an audible signal and tactical signal when the second piece is rotated about the collar and the at least one bump passes over at least one notched slot. Also, the lock is set in an engaged position to secure the at least one raised bump in at least one notched slot to prevent the second piece from rotating about the first piece and defining a first position, and the lock is set in a disengaged position to allow the second piece to rotate about the first piece until a second position is located.

The present invention is also directed to a wire cover having a first piece with a cylindrical collar, the collar having a plurality of notched slots disposed laterally along an outside surface. The cover includes a second piece configured to secure around the collar with a latch and a lock, the latch having at least one raised bump. The second piece is rotatable about the collar, and the at least one raised bump being configured to fit in each notched slot of the plurality of notched slots. The raised bump produces an audible and tactical signal when the second piece is rotated about the collar and the at least one bump passes over at least one notched slot, and the lock is set in an engaged position to secure the at least one raised bump in at least one notched slot to prevent the second piece from rotating about the first piece and defining a first position. The lock is set in a disengaged position to allow the second piece to rotate about the first piece until a second position is located.

An advantage of the present invention is multiple wire routing positions with a secure two-piece connector design.

Another advantage of the present invention is that second piece of the wire cover is movable to alternate positions, even after a first predetermined position is determined.

Another advantage of the present invention is that the latch may be manually or automatically actuated to locate a second predetermined position.

Yet another advantage of the present invention is that the wire cover has a position assurance feature that prevents the latch from actuating to a second position.

Still another advantage of the present invention is that once the wire cover is in place, no additional reinforcement such as tape is needed to secure the cover in position.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
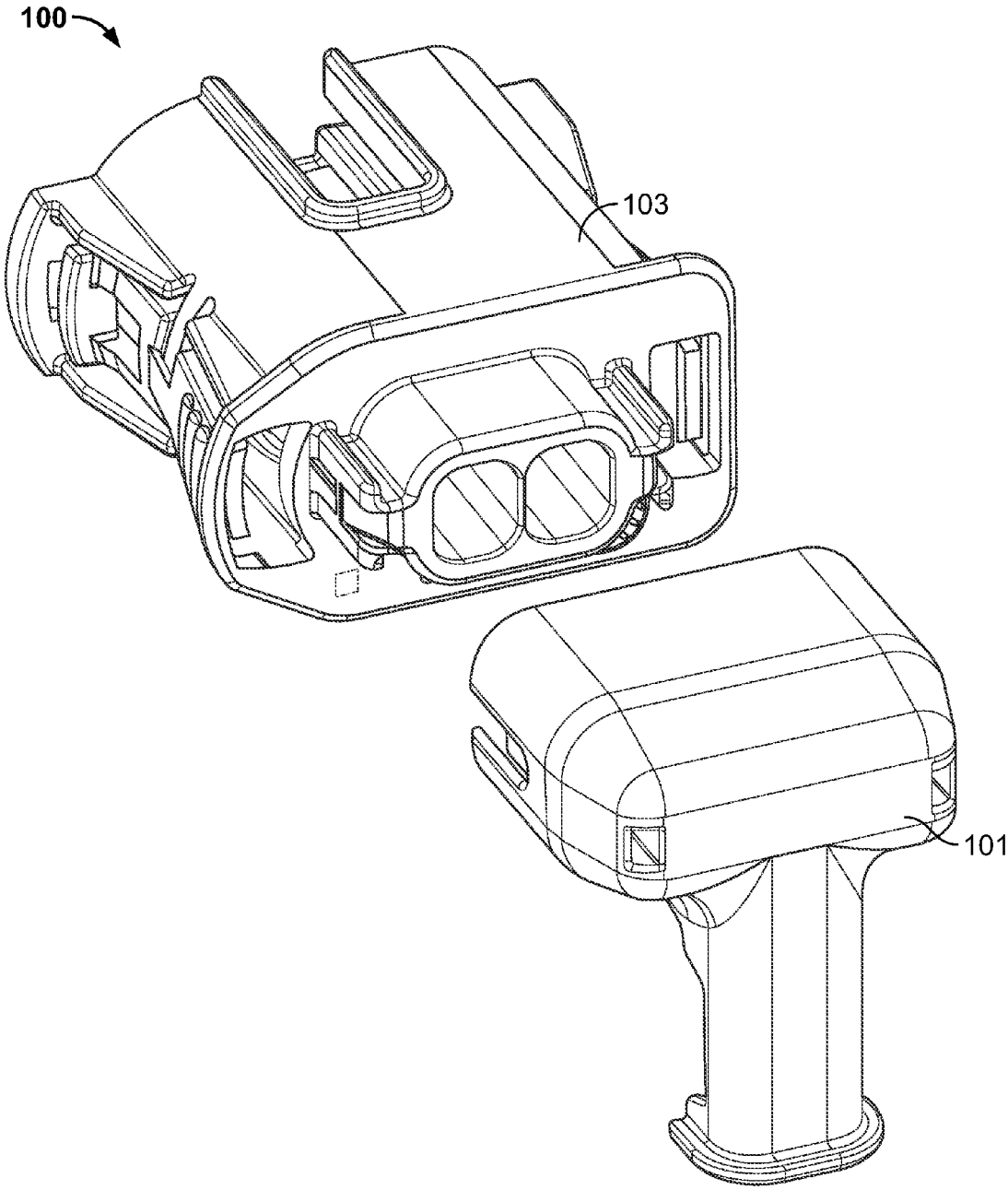
FIG. 1 (Prior Art)
FIG. 1 illustrates an exploded view of a prior art wire cover.
Figure 2:
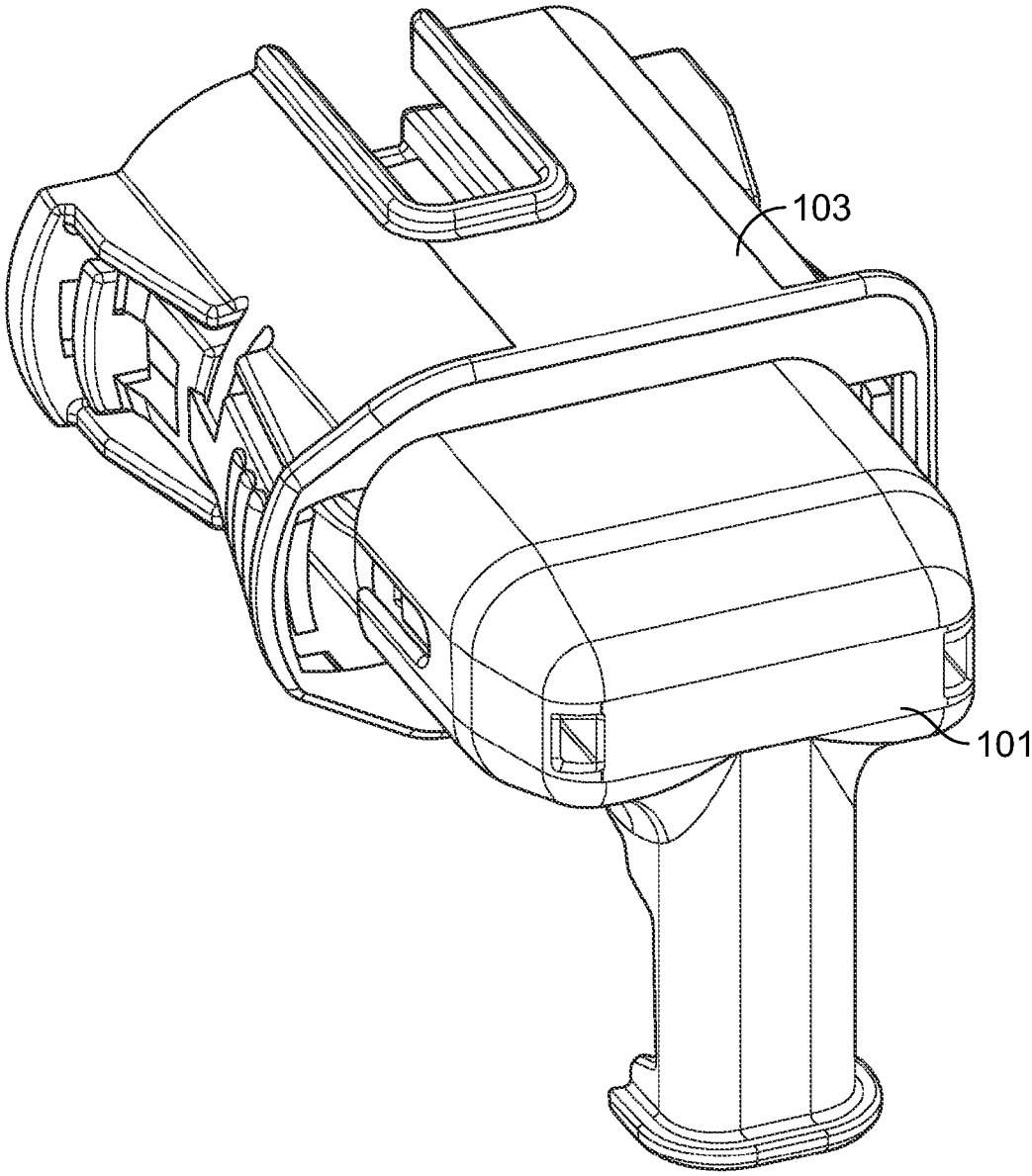
FIG. 2 (Prior Art)
FIG. 2 illustrates the prior art wire cover in the assembled position.
Figure 3:
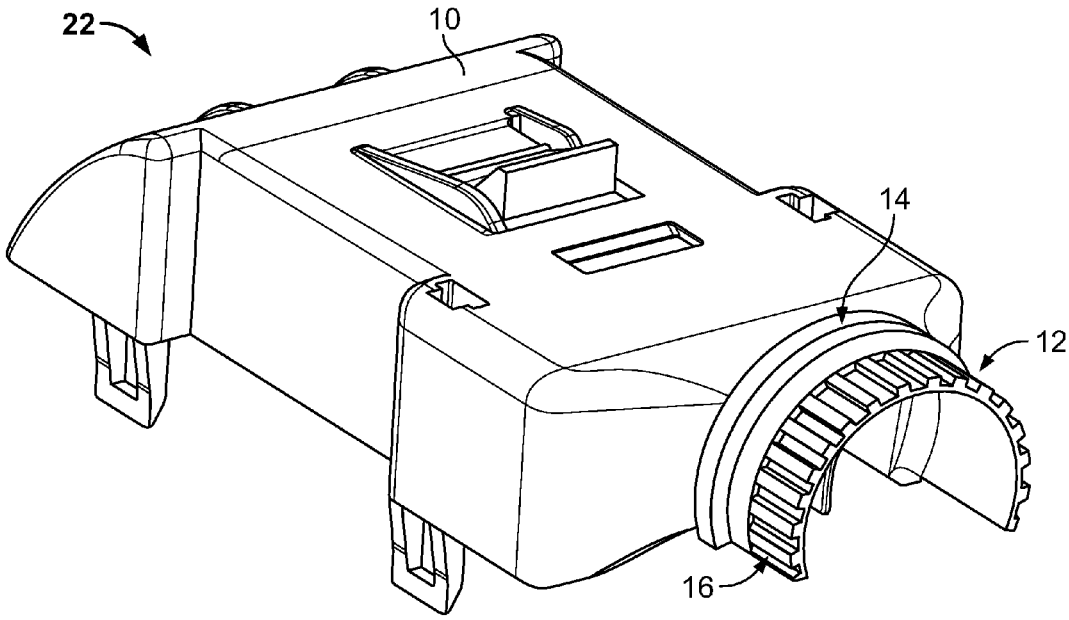
FIG. 3 illustrates the first piece of the wire cover.

Referring now to the drawings, FIG. 3 illustrates the first piece 22 of the two-piece wire cover 11 (Shown in FIG. 9) of the wire cover. The first piece 22 is a single molded body 10 with a protruding arcuate collar 12 with a raised rail 14 and a plurality of notched slots 16 extending longitudinally around the outer surface of the collar 12 in an axial direction away from the raised rail 14. The collar 12 protrudes from the body 10 of the first piece 22, to act as a receptacle for the second piece 24 (FIG. 4) of the wire cover, meaning that the second piece 24 fits over the collar 12 of the first piece 22. As shown in FIG. 3, arcuate collar 12 subscribes an arc that approximates the shape of a semi-cylinder, but is not restricted to this shape, as it may encompass more or less than a semi-cylinder or it may assume an elliptical or circular shape.

Figure 4:
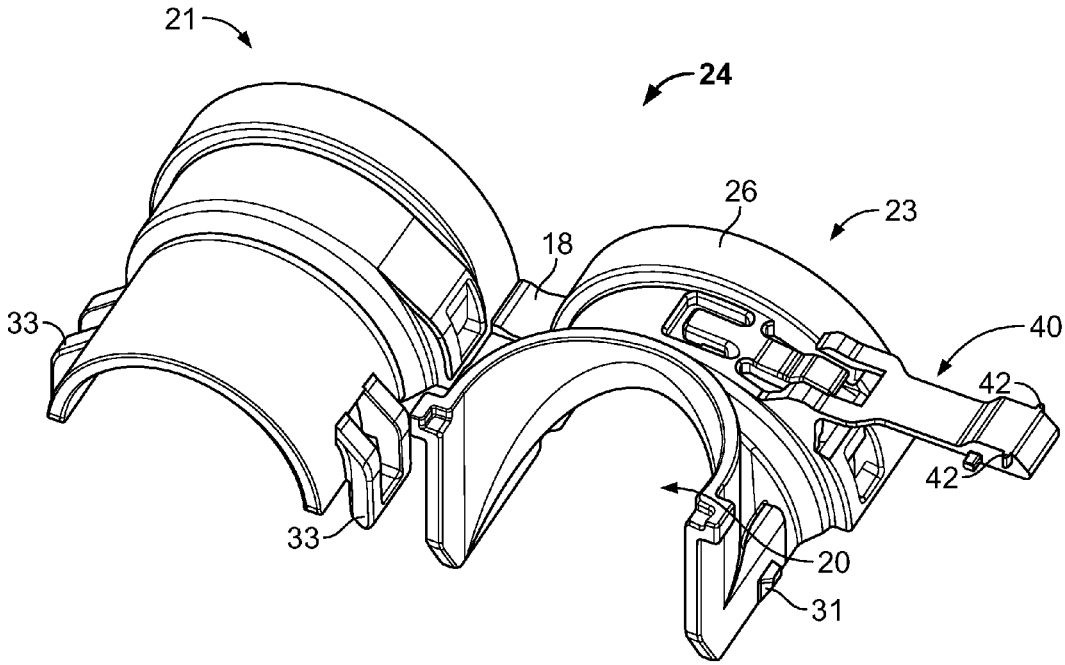
FIG. 4 illustrates a view of the second piece of the wire cover.

FIG. 4 illustrates an outside view of the second piece 24 of the two-piece wire cover 11 in an open position. The second piece has two halves, a first half 21 and a second half 23. The first half 21 and second half 23 are movable about and connected by a living hinge 18 or a plurality of living hinges 18. When the second piece 24 is in the open position, it can be placed over the collar 12 of the first piece 22 and create a directional ferrule. The two halves 21, 23 are in the open position when the latches 33 are not engaged with the protrusions 31. Once the second piece 24 is placed over the collar 12 of the first piece 22, the first half 21 can be rotated about the hinge 18 to engaged the latches 33 with the protrusions 31, thereby into a closed position, creating a ferrule around the collar 12 of the first piece 22. The second piece 24 is shaped such that when placed on the first piece 22 and closed, a secure fit is made around the collar 12. Upon closing the second piece 24 about the hinge 18, latches 33 engage with protrusions 31 to secure the second piece 24 in the closed position. A force may be applied to depress the protrusions 31 to open the second piece 24 about the hinge 18 if necessary.

Figure 5:
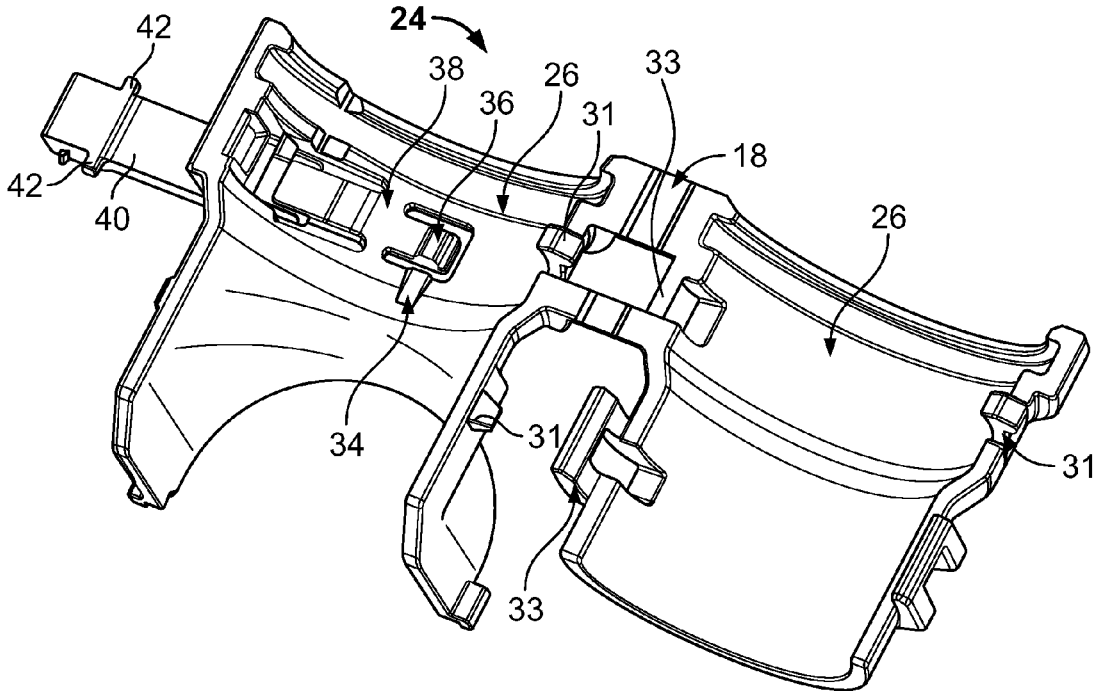
FIG. 5 illustrates an inside view of the second piece of the wire cover in the open position.

Referring to FIG. 5, the second piece 24 has a recessed channel 26 that accepts the raised rail 14 of the first piece 22. Once the second piece 24 is secured over the collar 12 of the first piece 22, the second piece 24 can rotate about the collar 12 while in the closed position.

Figure 6:
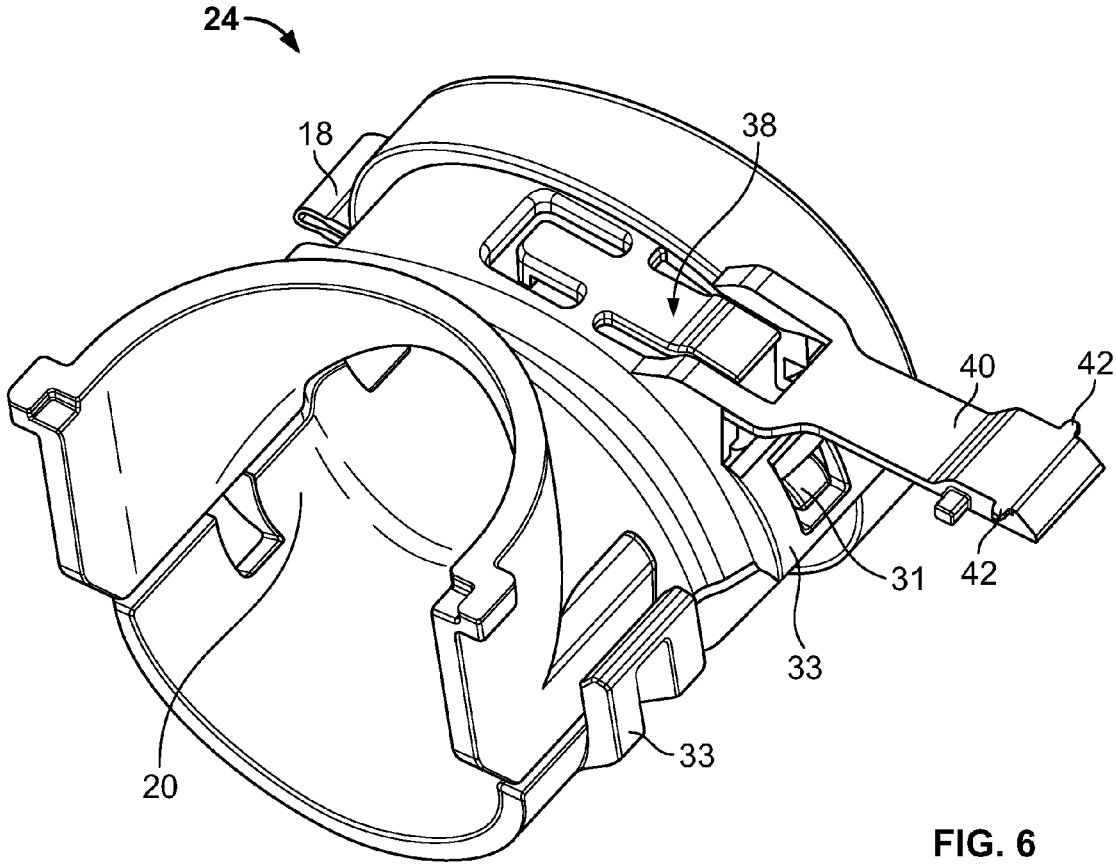
FIG. 6 illustrates a perspective view of the second piece of the wire cover in the closed position.

Referring to FIG. 6, an exit opening 20 on one portion of the second piece 24 allows the wires to be routed in a plurality of predetermined positions. The opening 20 is shaped in an elbow form, to allow the wires to exit and bend, if necessary. However, it should be noted from FIGS. 10-11 that the opening 20 is not a closed elbow, as a portion of the opening is not covered to allow for even more flexibility of the wires routed through the two piece wire cover. The wires exit the first piece 22 at a predetermined angle, and may exit the second piece 24 at the same predetermined angle, or the wires may be routed to exit the second piece 24 through the opening 20 at a different predetermined angle.

Referring back to FIG. 5, the second piece 24 has a raised bump 34 that is aligned to fit into the notched slots 16 of the collar 12 when the second piece 24 is assembled to the first piece 22. The raised bump 34 provides both a tactical feel and audible indication when the second piece 24 is rotated around the collar 12. Each instance where the raised bump 34 rests in a notched slot 16, a predetermined position is located. The second piece also has a latch 38 with a second bump 36 that fits into the notched slots 16 on the collar 12. The second bump is adjacent to the raised bump and aligns with the same notched slot as the raised bump 34. The second bump 36 is larger in size than the raised bump 34 and held to a tighter fit in the notched slots 16 than the raised bump 34. A greater force is necessary to move the second bump 36 between the notched slots 16. When the second piece 24 is being rotated about the collar 12, the latch 38 is self-actuating and is displaced each time the raised bump 34 and second bump 36 passed by a notched slot 16. The latch 38 moveably pivots to allow the second bump 36 to pass from one notched slot 16 to the next.

Figure 7:
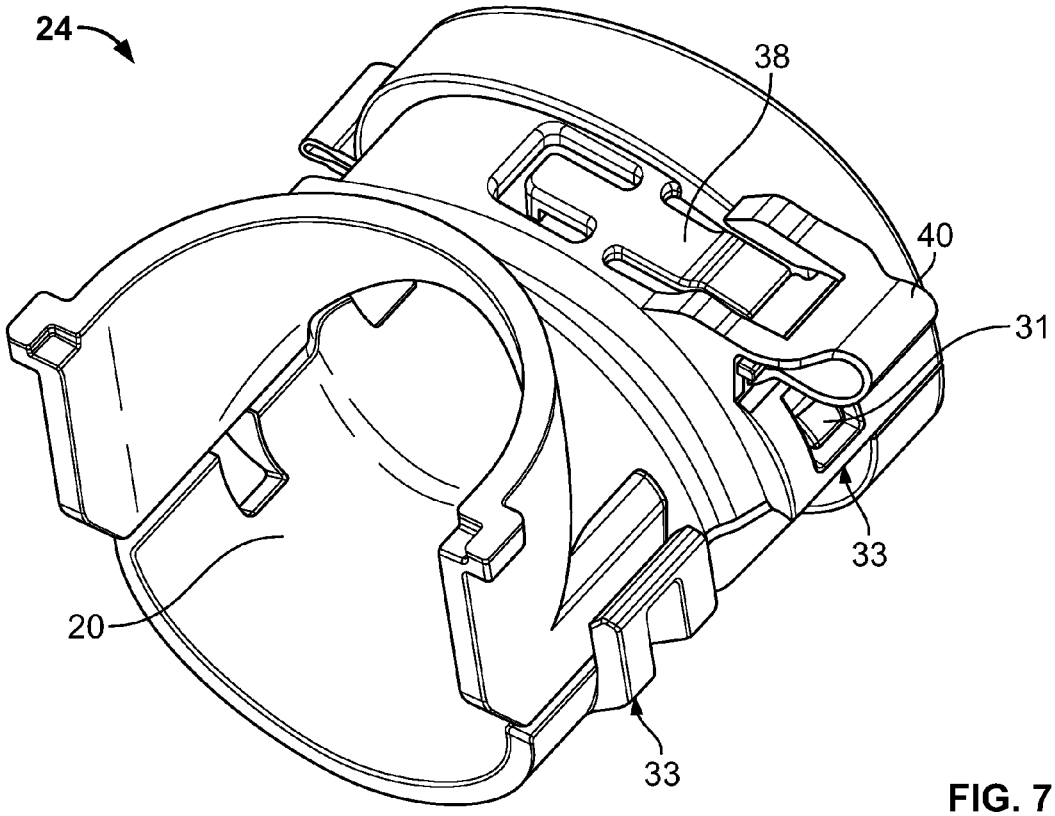
FIG. 7 illustrates the lock in the engaged position on the second piece shown in FIG. 9.
Figure 8:
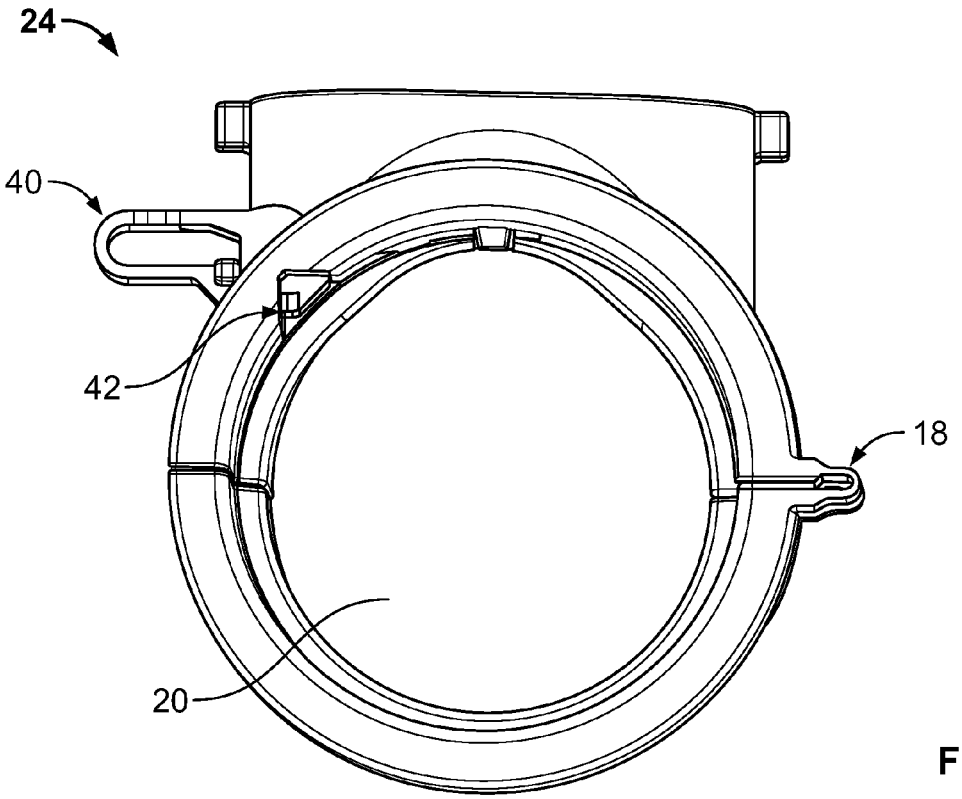
FIG. 8 illustrates a front view of the lock in the engaged position.

Referring to FIGS. 6-8, once the desired wire routing position is obtained, the flexible lock or position assurance feature 40 may be used to secure the second piece 24 in place and prevent the second piece 24 from rotating further around the collar 12. When the lock 40 secures the second piece 24 in place, the lock 40 is in the engaged position. In the engaged position, the lock 40 prevents the latch 38 from pivoting or being movably displaced from one notched slot 16 to the next. The second bump 36 is disposed in a notched slot 16, and cannot be displaced to move to the next adjacent notched slot 16. However, if a new position is desired or required after a preliminary position is selected, the lock 40 can be disengaged, and the latch 38 can then self actuate and displace or pivot to allow the second bump 36 to pass to the next notched slot 16. The second piece 24 is rotated to the desired position, and the lock 40 is reengaged to lock the second piece 24 in the new position.

As long as the lock 40 is in the disengaged position, the second piece 24 may rotate around the collar 12. The lock 40 may be secured in the engaged position by a fastener 42 or a plurality of fasteners 42. In the exemplary embodiments, the fasteners 42 are protrusions extending from one end of the lock 40 that engage with apertures (not shown) when in the engaged position. However, one of ordinary skill in the art would appreciate that any type of fastener may be used.

An exemplary embodiment of the present invention includes a second bump 36 that is held to a tighter fit in the notched slots 16, and is not easily displaced, even when a greater force is applied. The raised bump 34 provides an audible and tactical signal to notify the user when a position is located, and the second bump 36 secures the second piece 24 in place once a desired location is determined. However, though the second bump 36 in the exemplary embodiment is not easily displaced once secured in a notched slot 16, a force with a high enough magnitude may cause rotation of the second piece 24 about the collar 12, though this force may actually cause damage to the wire cover 11. Alternately, a user or a technician may depress the latch 38 to displace the second bump 36 from the notched slot 16 and allow the second piece 24 to rotate about the collar 12. Once the user releases the latch 38, the second bump 36 is secured in the notched slot 16 and not easily movable. Another exemplary embodiment of the present invention includes the latch 38 being unitary with the second piece 24, and not a separate piece. Still another exemplary embodiment of the present invention includes the position assurance feature 40 being unitary with the second piece 24, and not a separate piece. Yet another exemplary embodiment includes the present invention being used in an automotive application.

Figure 9:
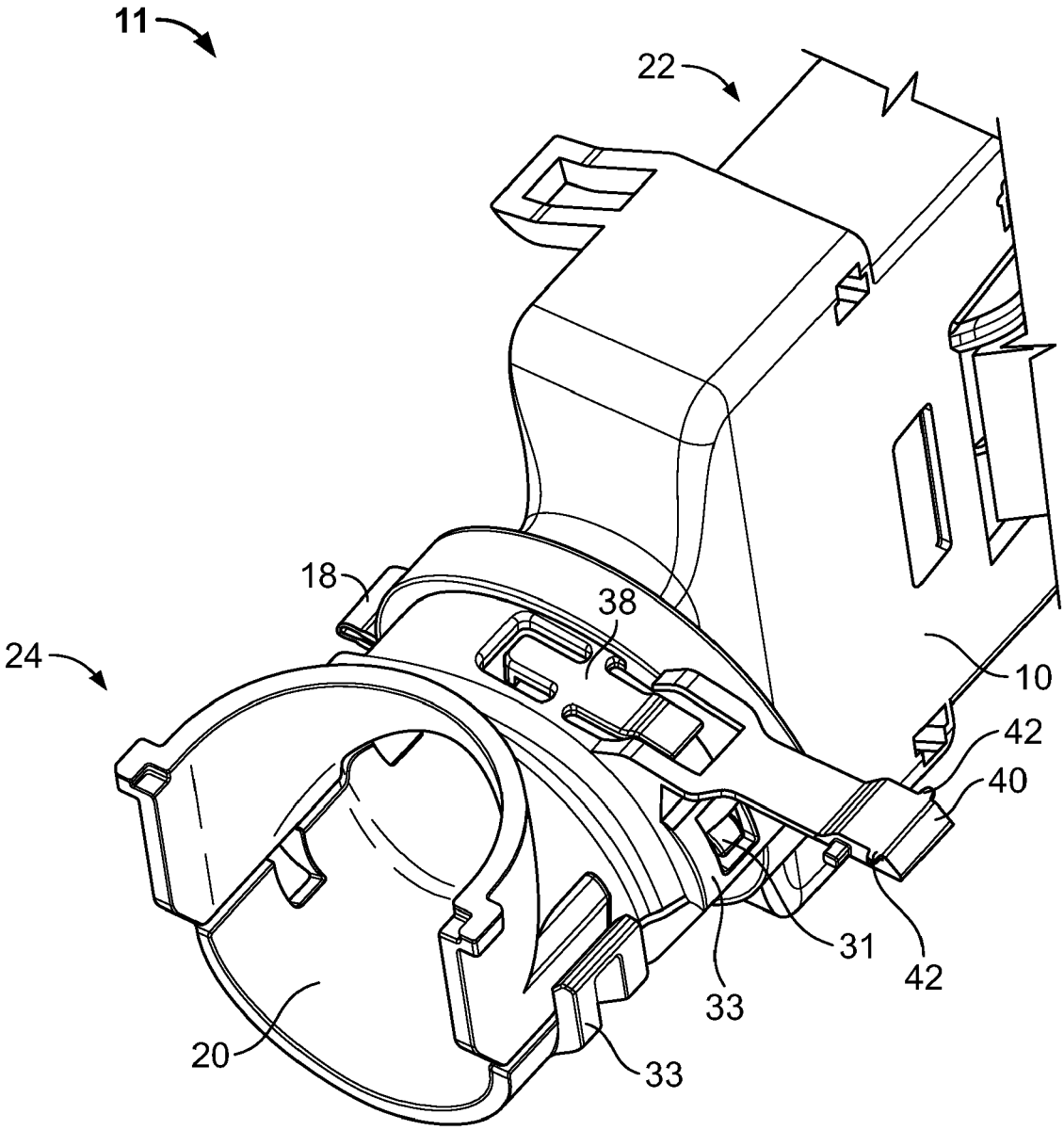
FIG. 9 illustrates the first and second pieces of the wire cover assembled together with the lock disengaged.
Figure 10:
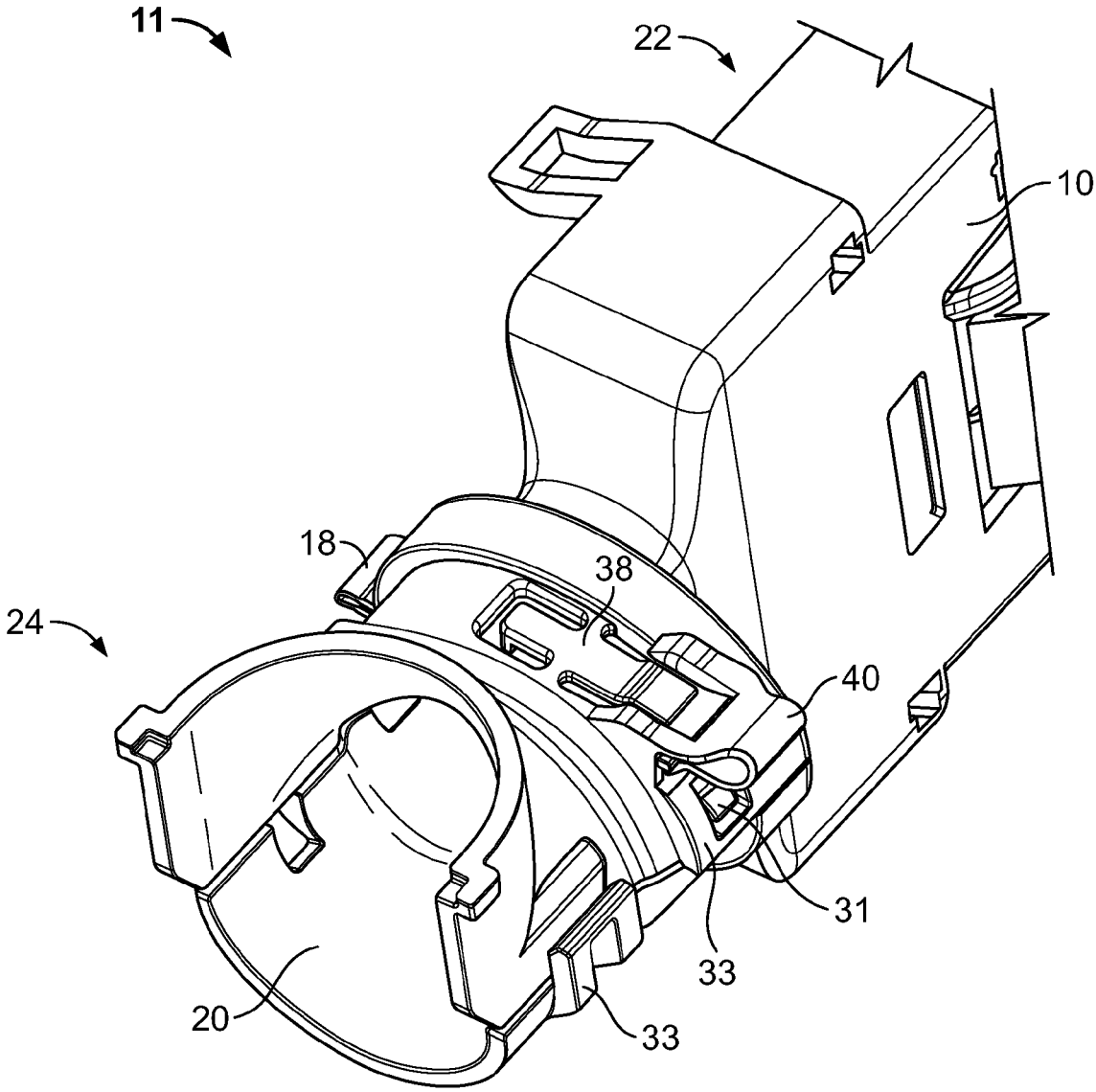
FIG. 10 illustrates the first and second pieces as shown in FIG. 9 with the lock engaged.

FIGS. 9 and 10 illustrate the first piece 22 and second piece 24 of the present invention assembled together. FIG. 9 illustrates the second piece 24 being closed around the first piece 22, with the lock 40 in the disengaged position. FIG. 10 illustrates the second piece 24 being closed around the first piece 22, with the lock 40 in the engaged position. In both FIGS. 9 and 10, the second piece 24 is aligned with the first piece 22 so that the recessed channel 26 of the second piece 24 is aligned with the collar 12 of the first piece 22. The collar 12 of the first piece is encased within the recessed channel 26 of the second piece 24 so that the second piece 24 is assembled onto the first piece 22. However, the recessed channel 26 is sized to provide a minimal clearance between the recessed channel 26 and the raised rail 14 without being able to remove the second piece 24 and still allow the second piece to be rotated along the collar 12. The second piece 24 can be rotated substantially 360 degrees around the collar 12 to a position within the restraints of the notched slots 16. As shown in the Figures, the collar 12 is not a full 360 degree surface with notched slots 16 around a full 360 degree surface. The collar 12 is more than 180 degrees, but less than 360 degrees, having notched slots 16 along the entire surface of the collar 12. For example, if the collar 12 has thirty-two notched slots 16, the second piece 24 is limited to thirty-two positions. While thirty-two notched slots 16 have been provided as an example, any number of notched slots may be used. Alternately, an additional piece (not shown) may be added and connected to the collar 12 with a living hinge. The additional piece completes the 360-degree surface of the collar 12 and provide a full 360 degrees of positions.

Figure 11:
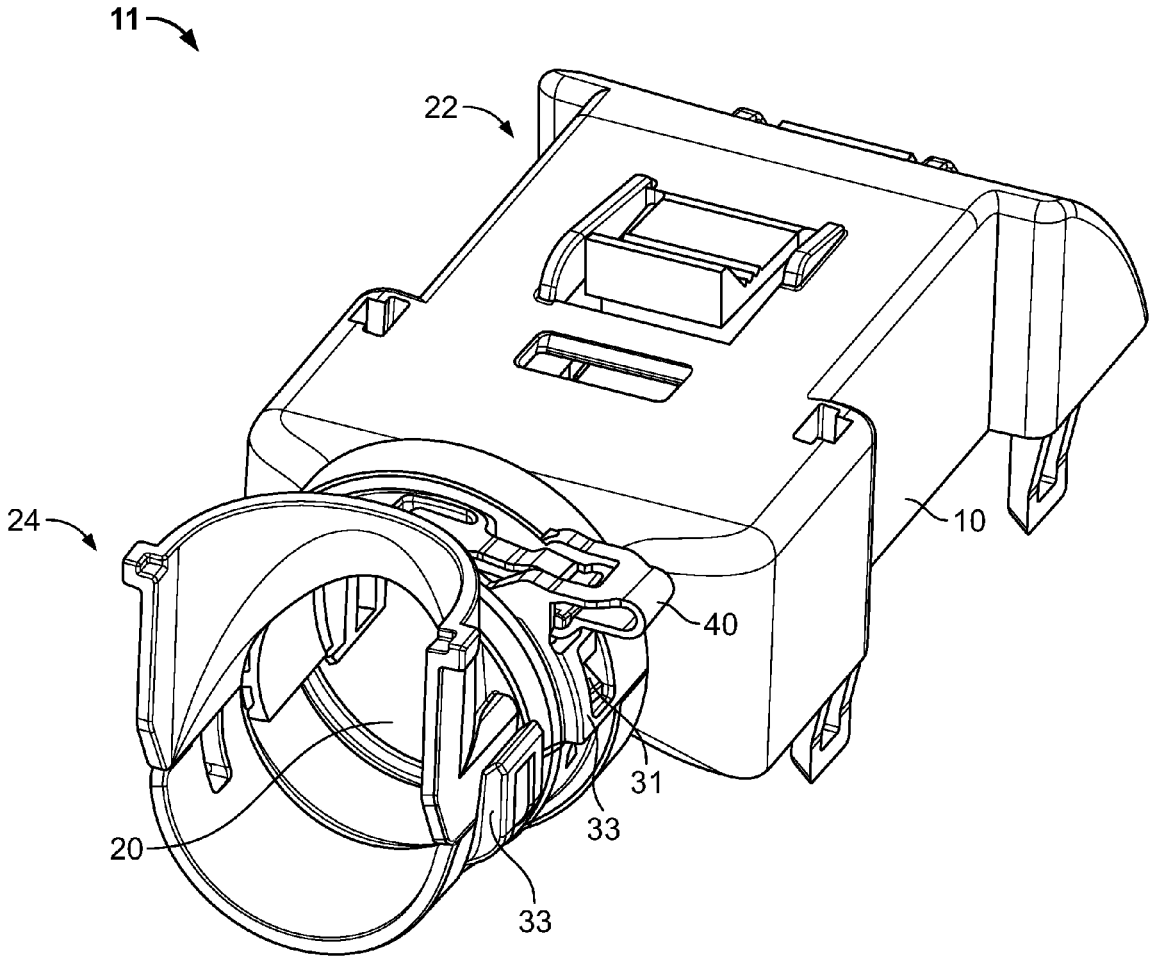
FIG. 11 illustrates an alternate position of the second piece.

FIG. 11 illustrates a different position of the second piece 24 as disposed on the collar 12. While the Figures illustrate discrete positions selected along the collar 12, one of ordinary skill in the art would appreciate that any position along the collar 12 is available, dependant upon the number of notched slots 16 provided along the collar 12. For example, thirty-six notched slots 16 would provide discrete positions at 100 intervals. While thirty-six notched slots 16 have been used as an example, the present invention is not limited to that number. In addition, both the first piece 22 and second piece 24 may be constructed of a durable material such as plastic or die cast metal.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A wire cover comprising:

a first piece with a collar, the collar having a plurality of notched slots along an outside surface; and a second piece having at least one raised bump, the second piece being configured to secure around the collar, the second piece having a latch, the latch having at least one raised bump;

wherein the second piece is rotatable about the collar, wherein the at least one raised bump of the second piece being configured to fit in each notched slot of the plurality of notched slots and producing an audible signal and tactical signal when the second piece is rotated about the collar and the at least one raised bump of the second piece passes over at least one notched slot, wherein the at least one raised bump of the latch fits in each notched slot of the plurality of notched slots, wherein when the second piece is rotated about the collar, the latch is displaced as the at least one raised bump of the latch passes over at least one notched slot and wherein the wire cover manages and routes wires in multiple positions.

2. The wire cover of claim 1 wherein a force is required to rotate the second piece about the collar and the latch is self actuating, displacing as the at least one raised bump of the latch passes over the at least one notched slot.

3. The wire cover of claim 1 wherein a user actuates the latch and displaces the latch to rotate the second piece about the collar.

4. The wire cover of claim 1 wherein the second piece has a first half and a second half, the first half and second half being connected by a hinge and movable about the hinge.

5. The wire cover of claim 1 wherein the at least one raised bump of the latch is larger than the at least one raised bump of the second piece and wherein the at least one raised bump of the second piece produces the audible and tactical signal and the at least one raised bump of the latch secures the second piece in a position around the collar piece.

6. The wire cover of claim 1, wherein the first piece further comprises a raised rail and wherein the second piece further comprises a recessed channel for receiving the raised rail of the first piece.

7. The system of claim 1 wherein the collar is cylindrical and the notched slots are disposed laterally around the outside surface of the collar.

8. The wire cover of claim 1 wherein the second piece further comprises a lock, wherein the lock is set in an engaged position to secure the at least one raised bump of the latch in at least one notched slot to prevent the second piece from rotating about the first piece and defining a first position, and wherein the lock is set in a disengaged position to allow the second piece to rotate about the first piece until a second position is located.

9. The wire cover of claim 8 wherein the lock further comprises at least one fastener to secure the lock in the engaged position.

10. The wire cover of claim 8 wherein the lock is a flexible strap and the lock and the second piece are unitary.

11. A wire management system for an automobile application comprising:

an automobile having a plurality of wires; and a wire cover further comprising:

a first piece with a collar, the collar having a plurality of notched slots along an outside surface;

a second piece having at least one raised bump, the second piece being configured to secure around the collar, the second piece having a latch, the latch having at least one raised bump;

wherein the second piece is rotatable about the collar, wherein the at least one raised bump of the second piece being configured to fit in each notched slot of the plurality of notched slots and producing an audible signal and tactical signal when the second piece is rotated about the collar and the at least one raised bump of the second piece passes over at least one notched slot, wherein the at least one raised bump of the latch fits in each notched slot of the plurality of notched slots, and wherein when the second piece is rotated about the collar, the latch is displaced as the at least one raised bump of the latch passes over at least one notched slot;

wherein the wire cover manages and routes the wires of the automobile in multiple positions.

12. The wire management system of claim 11 wherein a force is required to rotate the second piece about the collar and the latch is self actuating, displacing as the at least one raised bump of the latch passes over the at least one notched slot.

13. The wire management system of claim 11 wherein a user actuates the latch and displaces the latch to rotate the second piece about the collar.

14. The wire management system of claim 11 wherein the second piece has a first half and a second half, the first half and second half being connected by a hinge and movable about the hinge.

15. The wire management system of claim 11 wherein the at least one raised bump of the latch is larger than the at least one raised bump of the second piece and wherein the at least one raised bump of the second piece produces the audible and tactical signal and the at least one raised bump of the latch secures the second piece in a position around the collar piece.

16. The wire management system of claim 11, wherein the first piece further comprises a raised rail and wherein the second piece further comprises a recessed channel for receiving the raised rail of the first piece.

17. The wire management system of claim 11 wherein the collar is cylindrical and the notched slots are disposed laterally around the outside surface of the collar.

18. The wire management system of claim 11 wherein the second piece further comprises a lock, wherein the lock is set in an engaged position to secure the at least one raised bump of the latch in at least one notched slot to prevent the second piece from rotating about the first piece and defining a first position, and wherein the lock is set in a disengaged position to allow the second piece to rotate about the first piece until a second position is located.

19. The wire management system of claim 18 wherein the lock further comprises at least one fastener to secure the lock in the engaged position.

20. The wire cover of claim 18 wherein the lock is a flexible strap and the lock and the second piece are unitary.

21. A wire cover comprising:

a first piece with a collar, the collar having a plurality of notched slots along an outside surface; and a second piece having at least one raised bump, the second piece being configured to secure around the collar, the second piece having a latch and a lock, the latch having at least one raised bump;

wherein the second piece is rotatable about the collar, wherein the at least one raised bump of the second piece being configured to fit in each notched slot of the plurality of notched slots and producing an audible signal and tactical signal when the second piece is rotated about the collar and the at least one raised bump of the second piece passes over at least one notched slot, wherein the at least one raised bump of the latch fits in each notched slot of the plurality of notched slots, and wherein when the second piece is rotated about the collar, the latch is displaced as the at least one raised bump of the latch passes over at least one notched slot and wherein the lock is set in an engaged position to secure the at least one raised bump of the latch in at least one notched slot to prevent the second piece from rotating about the first piece and defining a first position, wherein the lock is set in a disengaged position to allow the second piece to rotate about the first piece until a second position is located and wherein the wire cover manages and routes wires in multiple positions.

22. The wire cover of claim 21 wherein a user actuates the latch and displaces the latch to rotate the second piece about the collar.

* * * * *